US007040014B2

(12) United States Patent
Shoji

(10) Patent No.: US 7,040,014 B2
(45) Date of Patent: May 9, 2006

(54) METHOD OF PRODUCING A HELICAL COIL CHIP

(75) Inventor: Shigeru Shoji, Tokyo (JP)

(73) Assignee: TDK Corporation, Tokyo (JP)

( * ) Notice: Subject to any disclaimer, the term of this patent is extended or adjusted under 35 U.S.C. 154(b) by 30 days.

(21) Appl. No.: 10/759,196

(22) Filed: Jan. 20, 2004

(65) Prior Publication Data

US 2004/0145443 A1 Jul. 29, 2004

(30) Foreign Application Priority Data

Jan. 21, 2003 (JP) ..... 2003-012046

(51) Int. Cl.
*H01R 43/00* (2006.01)

(52) U.S. Cl. ..... 29/872; 29/601; 29/602.1; 29/605; 29/606; 29/830; 29/846; 336/200; 336/223; 336/232

(58) Field of Classification Search ..... 29/872, 29/601, 602.1, 605, 606, 830, 846; 336/200, 336/223, 232; 156/89.12, 184, 187
See application file for complete search history.

(56) References Cited

U.S. PATENT DOCUMENTS 6,449,830 B1 * 9/2002 Amada et al. ..... 29/605
6,686,824 B1 * 2/2004 Yamamoto ..... 336/200

FOREIGN PATENT DOCUMENTS

| | | |
|---|---|---|
| CN | 1117655 | 2/1996 |
| JP | 59-103321 | 6/1984 |
| JP | 10-241943 | 9/1998 |
| JP | 11-204362 | 7/1999 |
| JP | 11-283834 | 10/1999 |
| JP | 2000-252127 | 9/2000 |

* cited by examiner

*Primary Examiner*—A. Dexter Tugbang
*Assistant Examiner*—Tim Phan
(74) *Attorney, Agent, or Firm*—Oblon, Spivak, McClelland, Maier & Neustadt, P.C.

(57) ABSTRACT

An object of the present invention is to provide a coil chip having a structure with which downsizing of the coil chip can be realized and a high inductance and a high Q can be obtained and to provide a method of producing such a coil chip. In order to attain the object, according to the present invention, there is provided a coil structure including a core member made of a material having low dielectric loss characteristics, a coil formed by metal plating and wound around the core member, and a layer functioning as a seed for metal plating provided between the core member and the coil.

5 Claims, 9 Drawing Sheets

METHOD OF PRODUCING A HELICAL COIL CHIP

CROSS REFERENCE TO RELATED DOCUMENT

This application claims priority to Japanese Patent Application No. 2003-012046, filed on Jan. 21, 2003, the entire contents of which are incorporated herein by reference.

BACKGROUND OF THE INVENTION

1. Field of the Invention

The present invention relates to a coil chip used at high frequencies for use in a small size and light weight electronic devices such as cellular phones or personal digital assistants (PDAs). More specifically, the present invention relates to a helical coil chip having high Q characteristics that is compact, short and lightweight enough to be equipped in various modules in cellular phones. The present invention also relates to a method for producing such a helical coil chip.

2. Related Background Art

In recent years, downsizing and weight reduction of mobile communication devices such as cellular phones have been drastically achieved. Consequently, downsizing, length reduction and weight reduction of high frequency coil chips to be equipped in chips and various modules used in those devices have also been required. So far, the size of the coil chip has been reduced to 1 mm or less in coil chip length and 0.5 mm or less in coil diameter (or width).

Such coil chips have been conventionally produced by winding a wire directly on a bobbin like in the case of producing larger coils, as disclosed for example in Japanese Patent Application laid-Open No. 2000-252127. However, it is considered impossible under the present circumstances to realize further downsizing with that production process, and therefore new producing technology is desired. At present, technologies using a non-winding process with which further downsizing of coil chips can be realized have been conceived and developed for practical application. Such technologies include, for example, a laser cutting process disclosed in Japanese Patent Application Laid-Open No. H11-204362 or a thin film formation technology disclosed in Japanese Patent Application Laid-Open No. H11-283834.

In the laser cutting process, a material to be formed into wound wire is applied as a coating film that covers a core member, and then the coating film is processed into a thin wire(s) using a laser beam. However, this process involves the disadvantage that the material for the core member may be restricted in view of the effects of laser irradiation. In addition, the processed surface may suffer from surface roughness after cutting by a laser beam, and therefore there is the risk that wire intervals can become irregular due to the surface roughness if the wire intervals are to be further decreased. In view of the above, it is considered that this process suffers from many problems to be solved when more compact coil chips are to be produced in the future.

In a production method using thin film forming technology, which is considered to be the most developed practical technology, several layers of coil patterns are connected through via-holes formed on insulating layers. However, in that method, when the coil chip is made more compact and the wire formed thereon is made thinner, it would be difficult to stop up the via-holes that have a significant length and a minute diameter corresponding to the wire. In addition, since it is practically impossible in that method to arrange a wound wire on the outermost surface, the method is structurally unfavorable for use in producing coils having high Q characteristics.

Generally, when coil chips having different cross sectional areas and the same inductance are to be produced, the larger the cross sectional area of the coil is, the smaller the number of windings of the coil should be. Therefore, if a coil is formed on the outermost surface of a chip, a larger inductance can be obtained even when the size and the number of windings of the chip is the same. When the cross sectional area of a coil is made small, it is necessary to increase the number of windings of the coil in order to maintain the inductance. However, an increase in the number of windings of the coil causes an increase in the direct current resistance of the coil and an increase in leak current between wound wires to lead to a decrease in the Q value.

Furthermore, an increase in the number of windings of a coil exaggerates the influence of dielectric loss caused by the dielectric material used for the core member of the coil. The dielectric loss increases with an increase in the frequency of the signal applied to the coil chip. As described above, it is difficult for the aforementioned thin film forming process to produce a coil chip having a wound wire formed on the outermost surface thereon, and therefore that process is considered to be unsuitable for use in producing coil chips for higher frequency applications.

Furthermore, when a coil chip is made compact, the capacitance between terminal electrodes for example is no more negligible when applications for ultra high frequencies are brought into view. In this case, in order to obtain a high Q, it is necessary to do away with opposed electrodes to reduce the capacitance between the electrodes and to make the resonance frequency related to the inductance of the coil and the capacitance between the electrodes higher than the used signal frequency. The larger the inductance is and the higher the used frequency is, the more greatly the influence of the capacitance between the electrodes is exaggerated. It has been difficult in normal chip coils in which terminal electrodes are opposed to each other to reduce capacitance.

SUMMARY OF THE INVENTION

The present invention has been made in view of the above-described situations. An object of the present invention is to provide a method of producing a coil chip that can produce downsized coil chips in the future and can be applied to production of coil chips having a high inductance and a high Q. Another object of the present invention is to provide a coil chip that can be favorably produced by that method.

In a helical coil chip according to the present invention that attains the above object, a material having low dielectric loss characteristics is used as a core member of the coil and a coiled conductor is wound on the outermost circumference of the core member by a one-time formation process using a thin film formation technology represented by semiconductor producing technology. Furthermore, terminal electrodes are formed on the surface on which the coil is formed, so that electrodes are arranged in such a way as not to be opposed to each other.

According to the present invention, there is provided a method of producing a helical coil chip comprising a step of forming a plurality of wires juxtaposed with predetermined intervals on an upper surface and a lower surface of a substrate by thin film formation processing means, a step of cutting the substrate in a direction different from the direction in which the wires extend, into a plurality of cut substrates, and a step of forming additional wires on the cut substrates to connect the plurality of wires juxtaposed on the upper and lower surfaces of the substrates respectively at the same time for all of the cut substrates by thin film formation processing means.

In this method of producing a helical coil chip according to the present invention, it is preferable that after the substrate is cut, the cut substrates be combined to form a collective substrate in which the cut surfaces of the cut substrates constitute upper and lower surfaces of the collective substrate, and the additional wires be formed on the upper and lower surfaces of the collective substrate. In addition, in the method of producing a helical coil chip according the present invention, it is preferable that the substrate be made of a material having low dielectric loss characteristics, and a terminal electrode be formed on either one of the surfaces of the cut substrate on which the wires or the additional wires are formed after the additional wires have been formed.

Furthermore, in order to attain the aforementioned object, a helical coil chip according to the present invention comprises a helical coil formed by connecting a plurality of wires formed to be juxtaposed on an upper surface and a lower surface of a substrate with a plurality of additional wires formed on a cut surface obtained by cutting the substrate in a direction different from the direction in which the wires extend into a plurality of cut substrates. In this helical coil chip, it is preferable that the substrate be made of a material having low dielectric loss characteristics, and a terminal electrode be provided on either one of the surfaces of the substrate on which the wires or the additional wires are formed.

In order to attain the aforementioned object, a method of producing a helical coil chip according to the present invention comprises a step of forming a plurality of wires extending parallel to each other with predetermined intervals on an upper surface and a lower surface of a substrate, wherein the wires on the upper and lower surfaces of the substrate are arranged to extend in the same direction, a step of cutting the substrate in a direction different from the direction in which the wires extend in such a way that the wires are cut to a predetermined length, into a plurality of cut substrate, a step of reconstructing the cut substrates as a collective substrate by means of an adhesive and a plurality of supplemental members, wherein the cut surfaces of the cut substrates are arranged to face upward and downward in the collective substrate, and a step of forming a plurality of wires, which have a length equal to the thickness of the substrate plus the thickness of the wires formed on the upper and lower surfaces of the substrate and extend parallel to each other with the aforementioned predetermined intervals, on the upper and lower surfaces of the collective substrate, wherein each of the plurality of wires connects end portions of the wires formed on the upper and lower surfaces of the substrate that pass through the thickness of the collective substrate.

In this method of producing a helical coil chip according to the present invention, it is preferable that each of the step of forming wires on the upper and lower surfaces of the substrate and the step of forming wires on the upper and lower surfaces of the collective substrate include a step of forming a protective film on the wires. In addition, in the method of producing a helical coil chip it is preferable that the step of forming a plurality of wires on the upper and lower surfaces of the collective substrate include a step of forming a terminal electrode of the helical coil chip on either one of the upper and lower surfaces of the collective substrate.

Furthermore, it is preferable that the step of reconstructing the cut substrates as a collective substrate by means of an adhesive and a plurality of supplemental members comprise a step of juxtaposing the plurality of supplemental members with regular intervals therebetween, each of the intervals being larger than the thickness of the substrate plus the thickness of the wires formed on the upper and lower surfaces of the substrate by a predetermined amount, a step of fitting each of the cut substrates to each of the interval spaces in such a way that the cut surfaces of the cut substrates are oriented in a direction perpendicular to the direction in which the supplemental members are juxtaposed a step of combining the cut substrates and the plurality of supplemental members by means of the adhesive, and a step of grinding such two faces of the cut substrates and the plurality of supplemental members that have been combined that are perpendicular to the direction in which the supplemental members are juxtaposed.

In addition, in the aforementioned method of producing a helical coil chip according to the present invention, it is preferable that the step of reconstructing the cut substrates as the collective substrate by means of an adhesive and a plurality of supplemental members comprise a step of orienting the cut surfaces of the substrates in a predetermined direction and arranging the cut substrates and the plurality of supplemental members alternately in a direction perpendicular to the aforementioned predetermined direction a step of combining the cut substrates and the plurality of supplemental members by means of the adhesive, and a step of grinding such two faces of the cut substrates and the plurality of supplemental members that have been combined that are oriented in the aforementioned predetermined direction so that end portions of the wires formed on the upper and lower surfaces of the substrate are exposed.

In order to attain the aforementioned object, it is preferable according to the present invention that a collective substrate to be used as a base material for a helical coil be prepared in producing a helical coil chip. Preferably, the collective substrate comprises core members arranged substantially parallel to each other with substantially regular intervals therebetween with their upper and lower surfaces being exposed at upper and lower surfaces of the collective substrate, which core members extend in a predetermined direction and having low dielectric loss characteristics, a plurality of wires in close contact with the core members, which plurality of wires pass through the collective substrate in a direction different from the direction in which the core members extends so that end portion of the wires are exposed at the upper and lower surfaces of the collective substrate, and a base portion that fills a space between the plurality of wires and the core members.

In order to attain the aforementioned object, a helical coil chip according to the present invention comprises a core member made of a material having low dielectric loss characteristics, a coil formed by metal plating and wound around the core member, and a layer functioning as a seed for metal plating provided between the core member and the coil. In that helical coil chip according to the present invention, it is preferable that the coil contain Cu as a main material and the seed contain CrCu or TiCu as a main material.

The present invention provides a coil chip in which a coil having a large cross sectional area is wound on the outer circumference of a core member utilizing a combination of thin film formation technology represented by a semiconductor producing technology or the like and a metal plating process suitable for formation of a thick film. Therefore, the coil chip according to the present invention includes a so-called seed material that facilitates metal plating provided between the core member and the coil wires. With this feature, the direct current resistance component can be reduced easily, and it is possible to provide a coil having a high Q.

DESCRIPTION OF THE PREFERRED EMBODIMENTS

Figure 1:
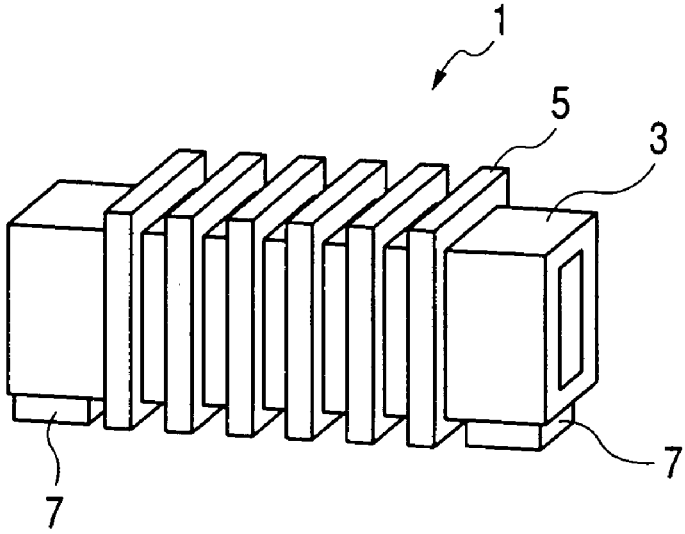
FIG. 1 schematically shows the structure of a helical coil chip according to the present invention.

FIG. 1 schematically shows the structure of the helical coil chip part (i.e. helical coil chip 1) according to the present invention. In order to reduce the dielectric loss, Teflon and a material mainly comprising vinylbenzyl having a low dielectric constant are used as materials for a core member 3. A wound wire 5 is formed in the following manner. First, seed layers of CrCu are formed on the core member 3 under vacuum condition, patterning is performed by means of a photo process, and then wires are formed on the seed by metal plating. Thus, the wires are formed as a multi-layer structure (in this embodiment, two-layer structure).

On the terminal electrodes 7 at both ends, there is provided a Ni (nickel) layer or a Ni alloy layer in order to improve wettability of the terminal electrodes with solder that may be used when the chip part is mounted. Actually, a layer made of a material with low dielectric loss such as an organic insulating film (for example, a material mainly comprising vinylbenzyl) is formed as a protection film on the outermost surface of the chip part. However, the illustration of the protection film is omitted in the chip part shown in FIG. 1 in order to facilitate understanding of the structure of the chip part.

Next, a process of producing the helical coil will be described with reference to FIGS. 2A to 2E. Firstly, thin CrCu films that constitute seeds of would wires are formed on both sides of a substrate 13 in the form of a substantially flat plate by sputtering. The substrate 13 is made of a material having low dielectric loss characteristics such as Teflon or vinylbenzyl. Then a dry film is attached to the outer surface of each thin CrCu film. The dry film is subjected to processing such as exposure and development for forming a wire pattern that constitutes a part of the wound wire.

After that, a thick Cu film is grown on the thin CrCu film by metal plating. Then the dry film is removed and the underlying film (the CrCu film) is removed by milling or wet etching etc. With the above-described process a part of the coil wires (which will be simply referred to as wires hereinafter). The thickness of the wires may be increased by repeating the above-described process of exposure, development and growth of the Cu film, if need be.

Figure 2A:
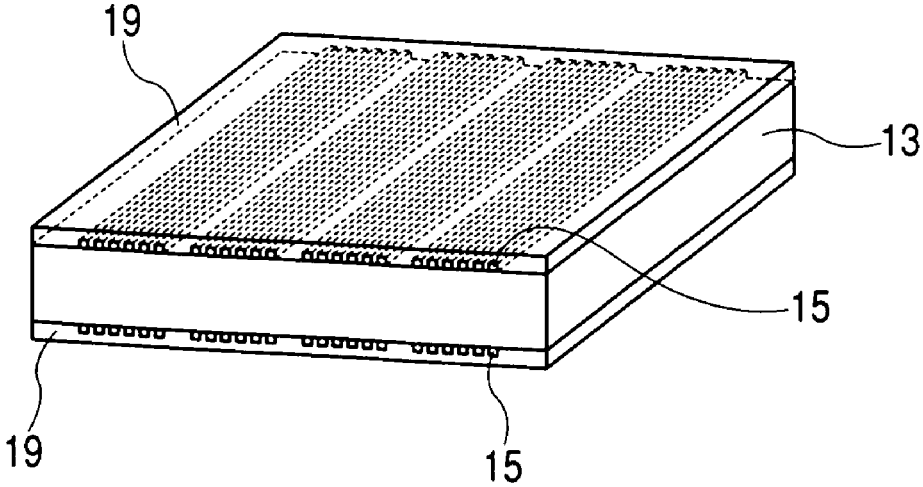
FIG. 2A illustrates a process of producing the helical coil chip shown in FIG. 1.
Figure 2B:
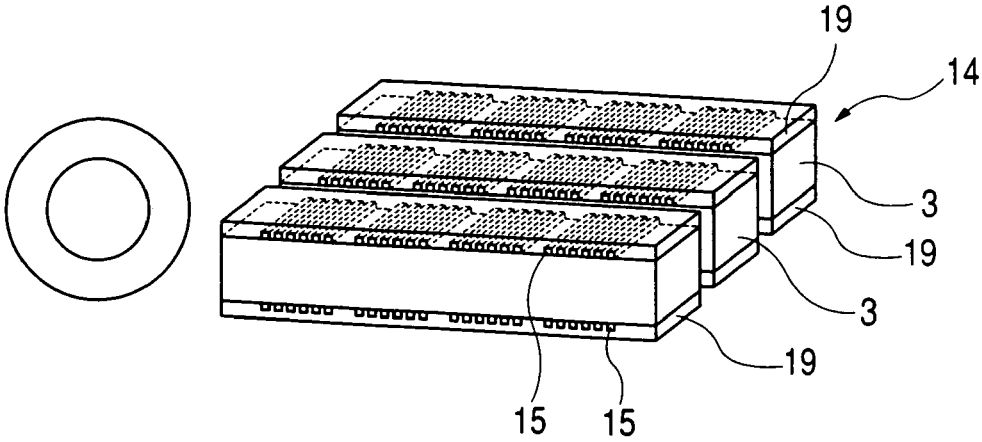
FIG. 2B illustrates a process of producing the helical coil chip shown in FIG. 1.
Figure 2C:
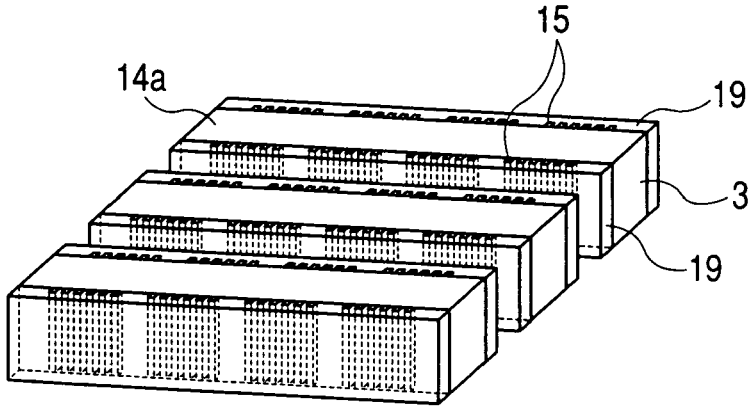
FIG. 2C illustrates a process of producing the helical coil chip shown in FIG. 1.

After the wires are formed, a protection film made of an epoxy, Teflon or a material mainly comprising vinylbenzyl etc. is formed on top of and between the wires as a cover layer 19. With the above-mentioned processes, a process base material shown in FIG. 2A is obtained. Next, the process base material is cut in the direction perpendicular to the direction in which the wires extend so that cut pieces have a predetermined dimension in the direction in which the wires extend as shown in FIG. 2C. Then, the rod like process base materials 14 after cutting are rotated by 90 degrees as shown in FIG. 2C.

Then, the rod like process base materials 14 are combined into a single collective substrate by a process that will be specifically described later. The rod like process base materials 14 on the collective substrate are held in such a way that the positional relationship of them is fixed under the state shown in FIG. 2C.

Then, thin CrCu films serving as seed layers for wires are formed on both the top and bottom surfaces of the collective substrate by sputtering. Then, dry films are attached to the thin CrCu films and the processes including exposure of a wiring pattern, development, removal of the thin film at the unnecessary positions etc. are performed again. With those processes, the seed layers for wires each of which connects ends of the wires 15 are formed. In this connection, only the ends of the wires 15 are exposed at both sides of the low dielectric loss material such as Teflon or a material mainly comprising vinylbenzyl that constitutes the core member 3. The wires thus formed are made thick by metal plating after a pattern is formed utilizing the dry film. Then the dry film is removed and the underlying layer is removed by milling or wet etching etc. Thus, the wires 16 that constitute the remaining part of the coil are formed.

Figure 2D:
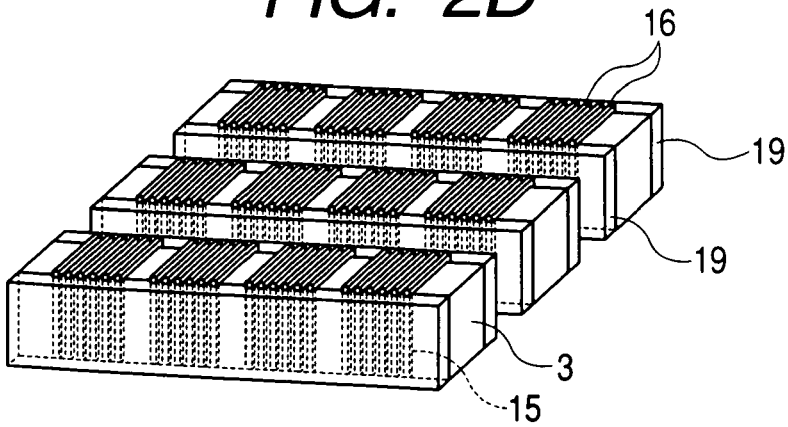
FIG. 2D illustrates a process of producing the helical coil chip shown in FIG. 1.
Figure 2E:
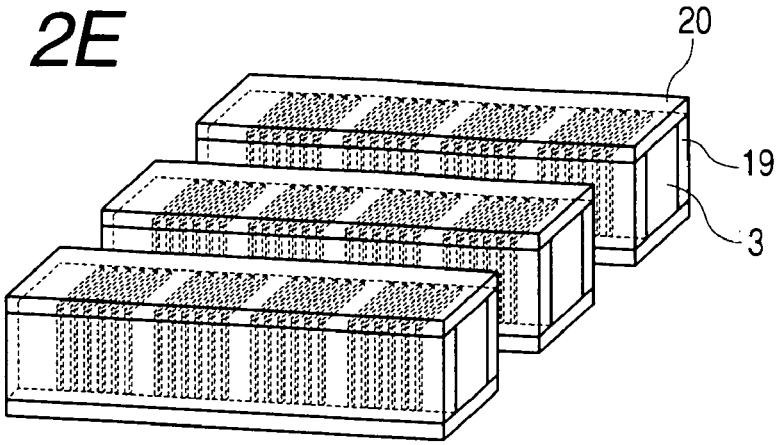
FIG. 2E illustrates a process of producing the helical coil chip shown in FIG. 1.

FIG. 2D shows the positional relationship of the rod like process base materials after the thickness of the wires has been increased. As shown in FIG. 2E, a protection film made of an epoxy, Teflon or vinylbenzyl etc. is formed as a cover layer 20 on top of and between the wires. After that, the terminal electrodes 7 including layered structures of Ni and solder are formed at the end portions of the coils and each process base material is cut and separated as a coil chip 1.

Figure 3A:
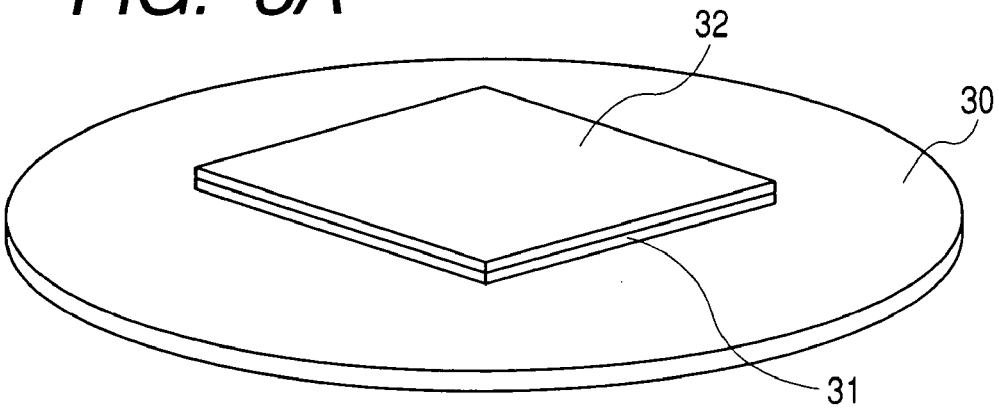
FIG. 3A illustrates a process of making a collective substrate.
Figure 3B:
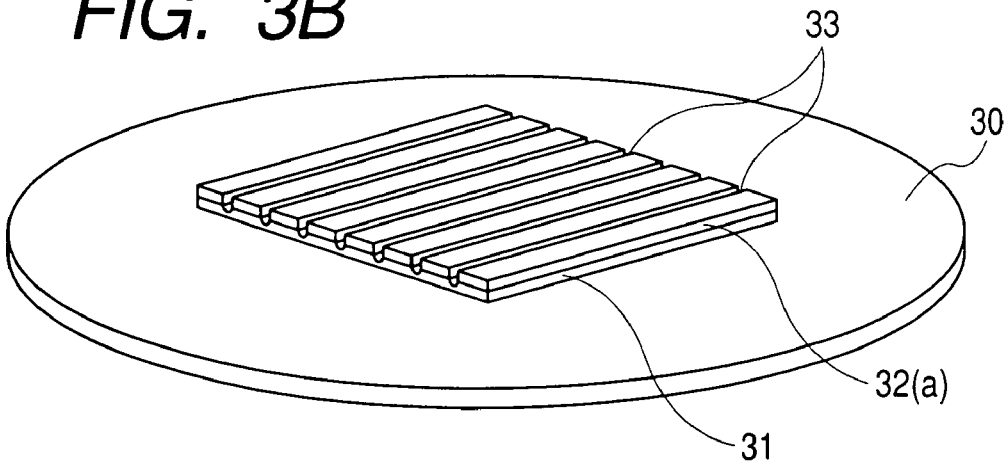
FIG. 3B illustrates a process of making the collective substrate.

Next, how the collective substrate is made will be described. Firstly, an adhesive tape 31 that can be released by application of ultraviolet radiation is attached to a glass plate 30 as shown in FIG. 3A and a plate member 32 made of a protection film material such as an epoxy, Teflon vinylbenzyl etc. is attached on the adhesive tape 31. Then, receiving grooves 33 are formed on the plate member 32 and the adhesive tape 31 as shown in FIG. 3B. The plate member 32 is divided into a plurality of supplemental members 32*a* by the receiving grooves thus formed.

As will be described later, the receiving grooves 33 are to receive the process base materials 14 that have been cut into rods in such a way that the cut surfaces (i.e. the surfaces on which wires have not been formed yet) 14*a* of the process base materials 14 are oriented to the upward and downward directions of the plate member 32*a* (or the plurality of supplemental members) (i.e. oriented to the directions perpendicular to the plane in which the supplemental members are juxtaposed). Therefore, the width of each receiving groove 33 is designed to be larger by a predetermined length than the distance between the outer surfaces of the cover layers 19 of the rod like process base material 14 on which the wires 15 and the cover layers 19 have already been formed. Specifically, the aforementioned predetermined length is set to 5 to 20 im in this embodiment.

Figure 3C:
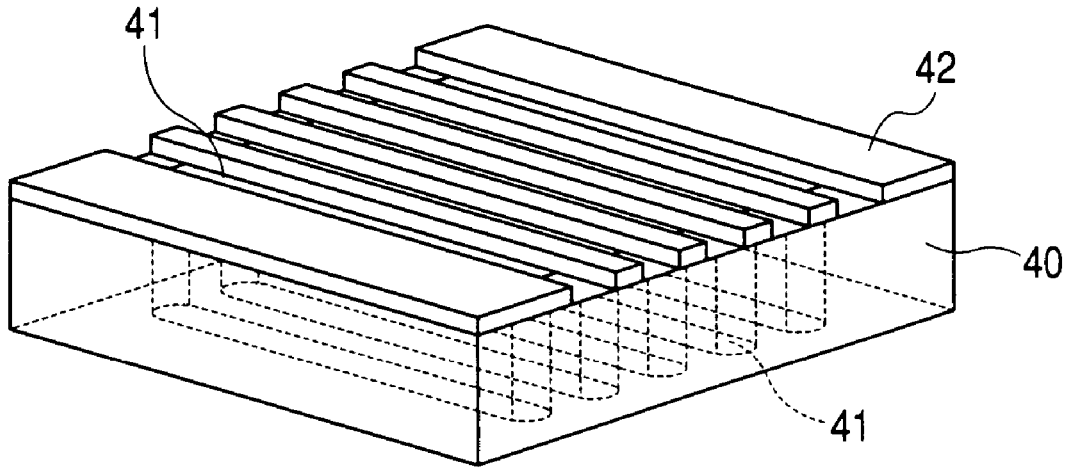
FIG. 3C illustrates a process of making the collective substrate.
Figure 3D:
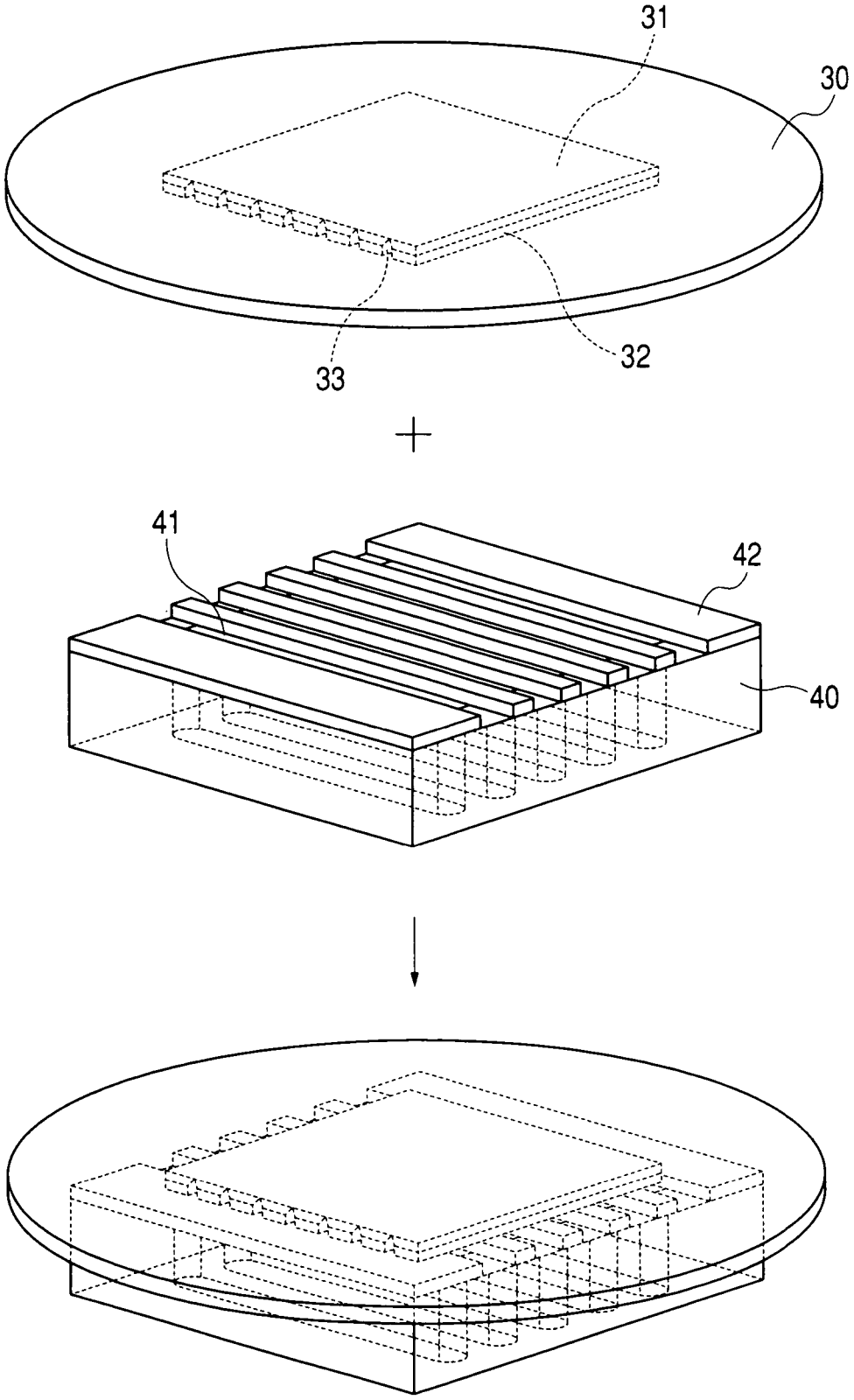
FIG. 3D illustrates a process of making the collective substrate.
Figure 3E:
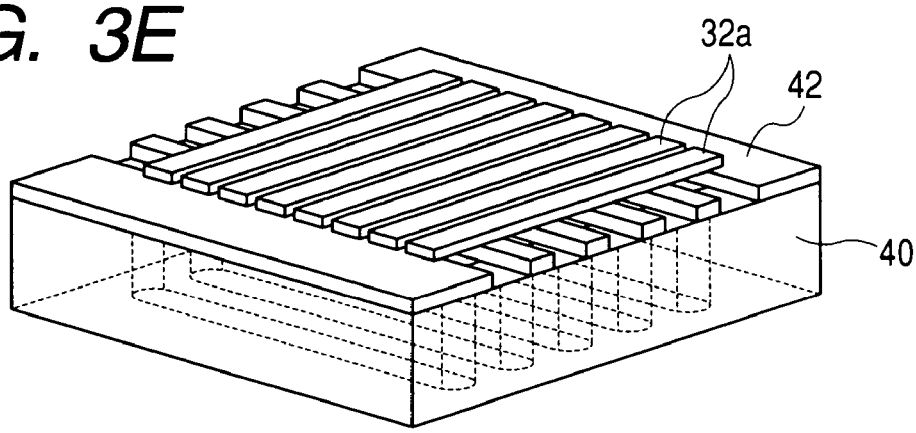
FIG. 3E illustrates a process of making the collective substrate.

In addition to the glass substrate shown in FIG. 3B, a thick plate 40 having multiple parallel grooves 41 that pass through the plate to open at the top and bottom surfaces thereof as shown in FIG. 3C is prepared. As shown in FIG. 3C, thermally foaming adhesive tapes 42 are attached to the upper surface of the thick plate in such a way as to cover the portion other than the parallel grooves 41. The thermally foaming tape 42 is a tape that can be easily released by application of heat. The glass substrate 30 on which the grooves have been formed as shown in FIG. 3B is adhered to the upper surface of the thick plate 40 with the plate member 32 facing the upper surface of the thick plate 40 and with the receiving grooves 33 being oriented to form an angle of about 90° relative to the grooves of the thick plate 40 (FIG. 3D). After the adhesion, the glass plate 30 is subjected to irradiation with ultraviolet light so that the adhesive tape 31 is released. Thus, the product shown in FIG. 3E in which the plate members in the form of a plurality of supplemental members 32*a* are adhered to the thermally foaming adhesive tapes 42 on the thick plate 40 with controlled intervals between the supplemental members is obtained.

Figure 3F:
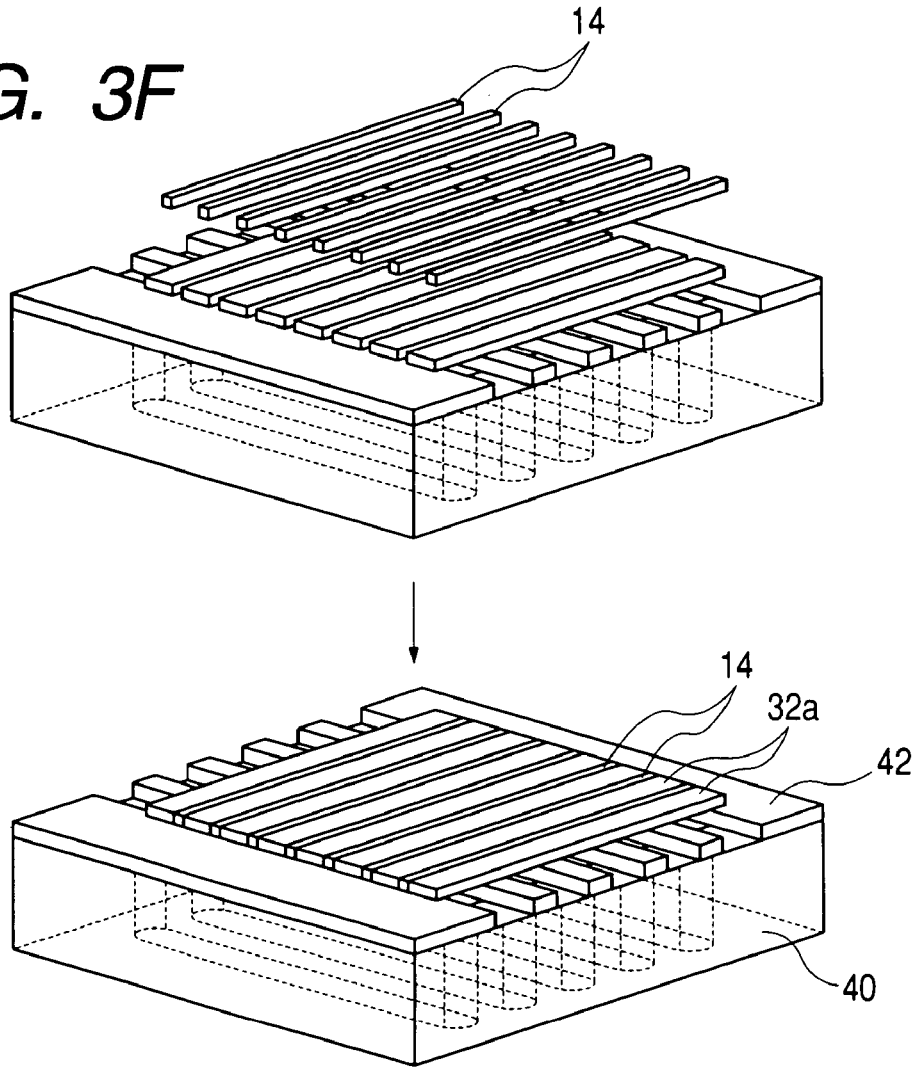
FIG. 3F illustrates a process of making the collective substrate.

Subsequently, the process base materials 14 that have been cut into a rod shape are inserted into the spaces between the plate members 32*a* as shown in FIG. 3F. The rod like process base materials 14 are also adhered to the thermally foaming tapes 42. Upon adhesion, each process base material 14 is disposed in such a way that its two surfaces on which films have not been formed (i.e. the cut surfaces 14*a*) are oriented to the thickness direction of the thick plate 40 (i.e. facing upward and downward in FIG. 3F). The process base material 14 that have been cut into a rod shape might have deflection or the like created by stress applied upon cutting. However, since the width of the receiving grooves 33 is designed to be larger than the width of the rod-like process base materials 14 by 5 to 20 im, the process base materials 14*a* can be easily received by the receiving grooves 33.

Figure 3G:
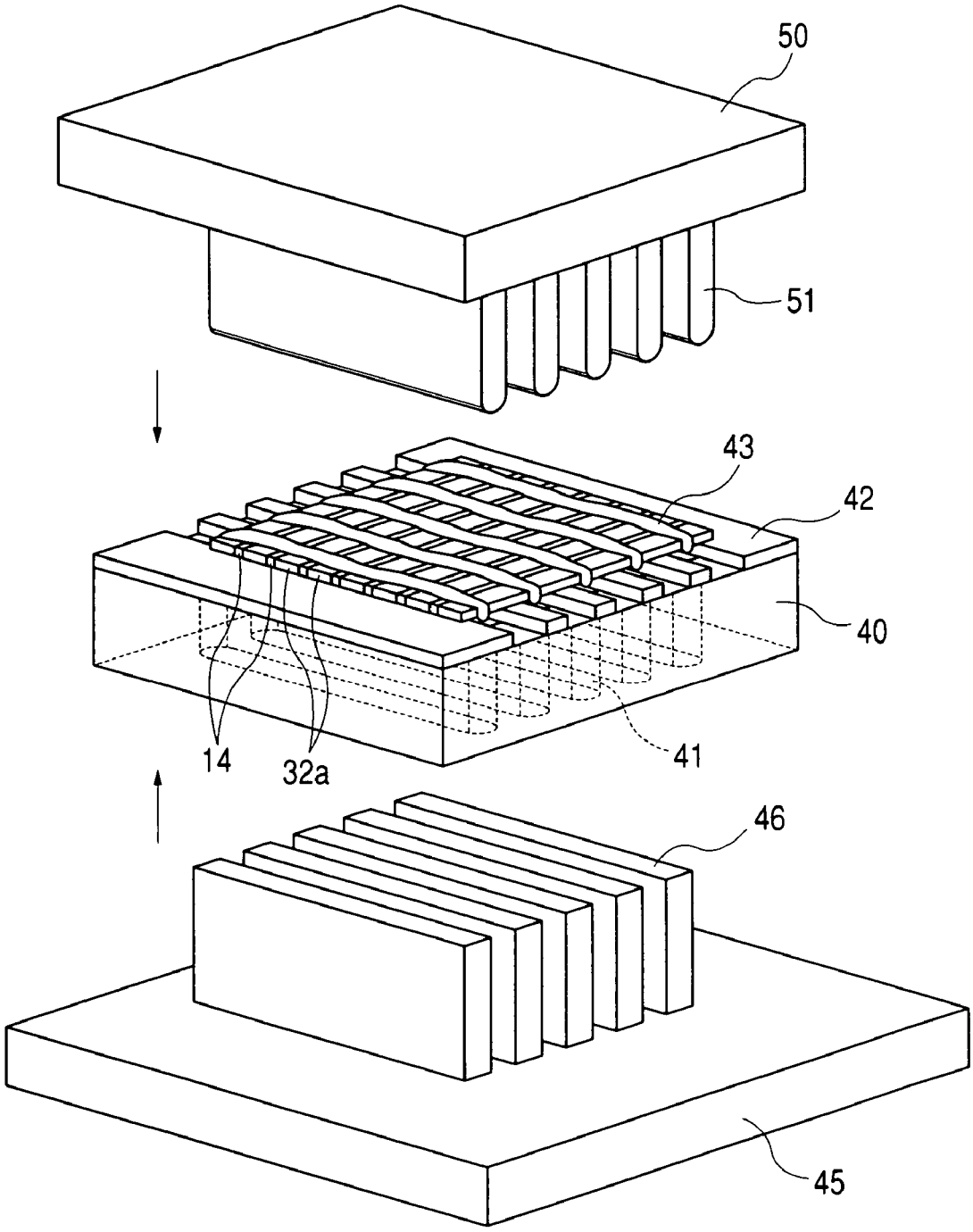
FIG. 3G illustrates a process of making the collective substrate.
Figure 3H:
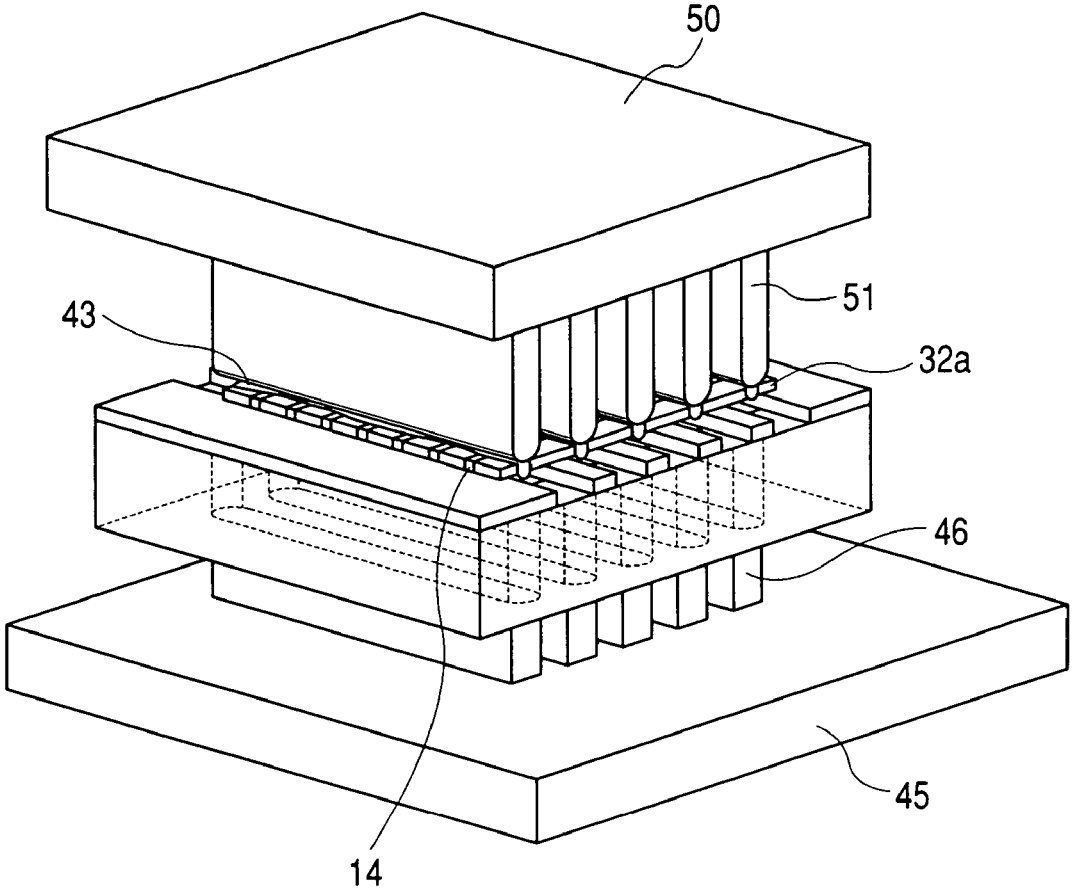
FIG. 3H illustrates a process of making the collective substrate.

Furthermore, in order to combine the multiple plate members 32*a* and the process base materials 14, an adhesive 43 is applied to the areas of the plate members 32*a* and the process base materials 14 on which the thermally foaming tapes 42 are not present. In other words, the adhesive 43 is applied to the portions of the plate members 32*a* and the process base materials 14 corresponding to the position of the parallel grooves 41 of the thick plate. After the adhesive 43 is applied, the portions on which the adhesive coating is applied are pressed by jigs as shown in FIG. 3G in order to combine the plate members and the process base materials while maintaining their positional relationship. The pressing jigs include a groove insertion jig 45 and a coated portion pressing jig 50.

The groove insertion jig 45 can be inserted into the parallel grooves 41 of the thick plate 40 and has a plurality of projecting portions 46. The length of the projecting portions 46 of the groove insertion jig 45 is large enough to be in contact with all of the process base materials 14. In addition, the upper end faces of the projecting portions 46 are coplanar. It is preferable that the projecting portions 46, especially the top end faces thereof, be coated with a release agent (such as a fluorocarbon resin etc.) that has high adhesive releasing properties, since the top faces are to be in contact with adhesive as will be described later. The coating portion pressing jig 50 has a plurality of projecting portions 51 for holding and fixing the process base materials 14 and the plate members 32*a* between themselves and the top faces of the projecting portions 46 of the groove insertion jig 45. The length of the projecting portions 51 is the same as the length of the projecting portions 46 and the end faces of the projecting portions 51 are coplanar. It is preferable that these projecting portions 51 be also coated with a release agent, since they are also to be in contact with adhesive as is the case with the aforementioned projecting portions 46.

Figure 3I:
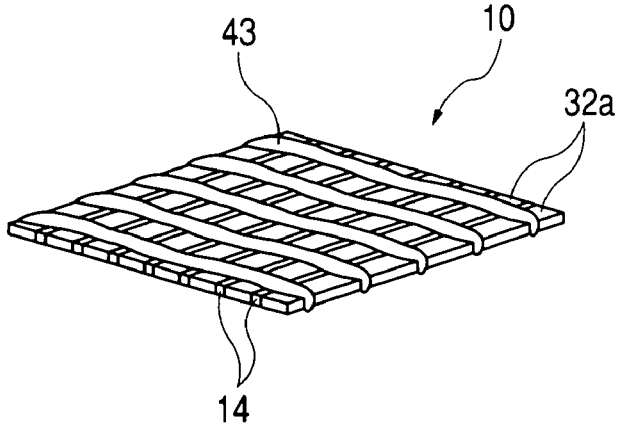
FIG. 3I illustrates a process of making the collective substrate.

The process base materials 14 and the plate members 32*a* are heated under the state in which they are held to be fixed by the jigs 45 and 50 so that the adhesive is cured. With this heating process, the thermally foaming tapes 42 lose adhesivity, so that the process base materials 14 and the plate members 32*a* can be easily detached from the thick plate 40. The process base materials 14 and the plate members 32*a* thus combined partially by the adhesive 43 as shown in FIG. 3I are then dipped in an adhesive. After that, they are held by means of the aforementioned jigs 45 and 50 and heated again so that the adhesive is cured. Having been processed as above, the plurality of plate members 32*a* and the plurality of process base materials 14 are integrally combined as the collective substrate 10.

After subjected to a shaping processing performed on the four corners, the collective substrate 10 is inserted into a recess 55 having a specific dimension provided on a reference outer frame 53. The collective substrate 10 is secured to a grinding apparatus by means of the outer frame 53, so that both the surfaces of the collective substrate 10 are ground. The state of wires observed on the surface of the collective substrate 10 after completion of the grinding is schematically illustrated in FIG. 3K that shows a part of the surface in an enlarged manner. On the surface of the collective substrate, there is observed plate members 32*a*, substrates 3 serving as core members sandwiched between the plate members 32*a* and the end portion of the wires 15 arranged on both sides of each of the substrates 3. In addition, adhesive layers filling the spaces between the plate members and the substrates, between the wires and between the plate members can also be observed. In connection with this, the part composed of the adhesive and the cover layer etc. constitutes a base portion other than the wires 15 and the core members 3 in the collective substrate 10.

The collective member under the above-described state is subjected to the aforementioned processes such as CrCu film formation and patterning etc., so that the wires 15 on both sides of the substrate 3 exposed to the surface of the collective member are connected by newly formed wires 16. With these processing performed on both sides of the collective substrate, wires 5 having a two-layered structure of CrCu and Cu wound around the circumference of the vinylbenzyl substrate are obtained. Thus, a ultra micro helical coil with a core member 3 made of Teflon or a material mainly comprising vinylbenzyl etc. is produced.

Figure 3J:
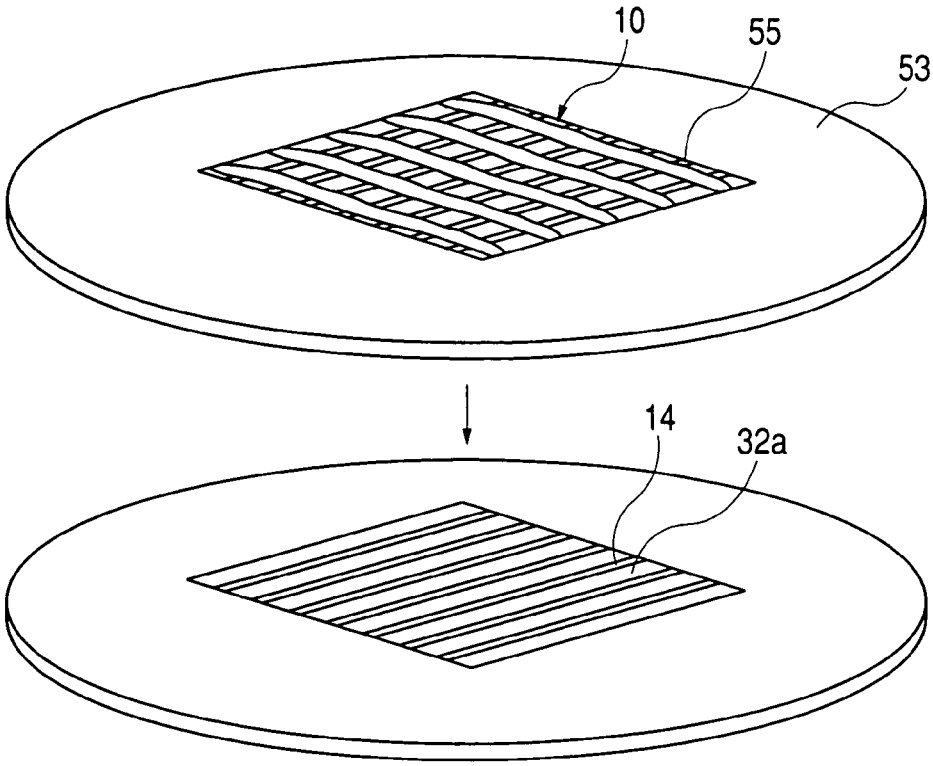
FIG. 3J illustrates a process of making the collective substrate.
Figure 3K:
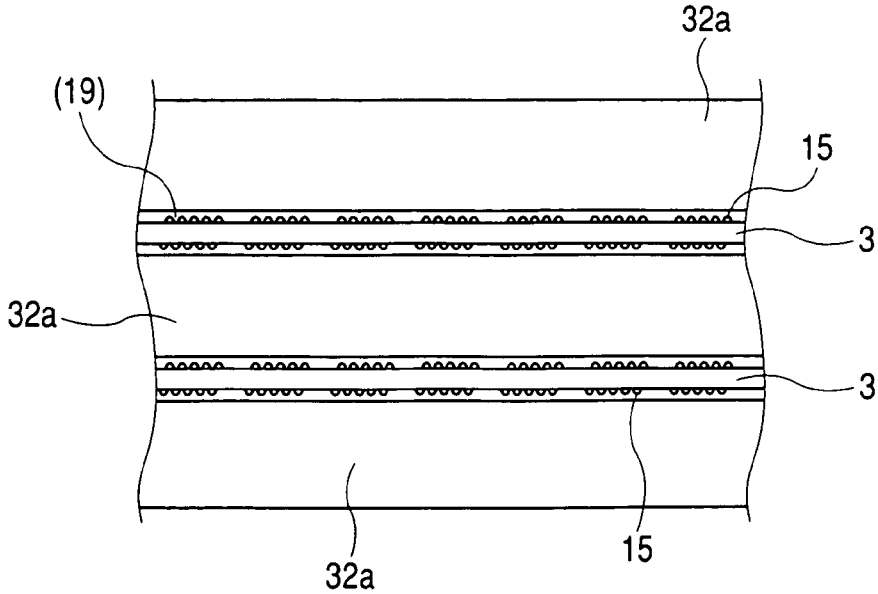
FIG. 3K shows an enlarged view of a surface of a collective substrate.

Actually, the substrates and the end portions of wires observed on the surface of the collective member shown in FIG. 3J are curved in their shape in the direction perpendicular to their longitudinal direction, and therefore it is not possible to apply normal one-time exposure to them. Therefore, in this embodiment so-called dye-by-dye exposure is adopted. In the dye-by-dye exposure, the image of wire end portions corresponding to each coil or several coils are analyzed so that the exposure position is determined for subsequent exposure process to be performed.

While exposure of the collective member for forming the wires is performed as dye-by-dye exposure in this embodiment, the terminal electrodes made of Ni and solder etc. are formed by a normal exposure process. That is because the size of the terminal electrodes is large as compared to that of the wire end portions and the required accuracy in position is low as compared to that of the wire end portions. With the use of the normal exposure process upon forming the terminal electrodes, it is possible to enhance productivity of the coil.

With the above-described production process, a helical coil shown in FIG. 1 is produced. With that process, it is easy to produce more compact coil chips. In addition, since it is possible to dispose a coil on the outermost surface of a core member, a coil chip having a high inductance and a high Q can be produced. In addition, with the above-described process, it is easily possible to form terminal electrodes on one surface of a coil chip. With such an arrangement of the terminal electrodes, it is possible to produce a high Q helical coil in which the capacitance created by the electrodes is reduced at reduced cost.

Although this embodiment has been described with reference to the core member made of Teflon and a material mainly comprising vinylbenzyl etc., the present invention is not limited to that feature. Various low dielectric loss materials such as fluorocarbon resins like terrafluoroethylene resin or resin materials including glass fiber etc. may also be used. Furthermore, although CrCu is used as an underlying film or a seed for wires, various materials such as TiCu etc. may be used. Similarly, the materials of the terminals are not limited to two-layered Ni and solder. Although in this embodiment the materials for the seed and the terminal are applied by sputtering, the present invention is not limited to that feature. Various processes such as vapor deposition, CVD or the like may also be used for applying those materials.

In this embodiment, it is preferable that all of the parts other than the wires be composed of the same material (for example, a material mainly comprising vinylbenzyl) so that the grinding rate in the grinding process will not vary greatly depending on the grinding position. However, the present invention is not limited to that case, but various materials with a low dielectric loss and adhesives etc. may be used so long as almost the same grinding rate can be realized. Furthermore, various materials other than Teflon or a material mainly comprising vinylbenzyl may be used so long as they have desired characteristics such as low dielectric loss etc.

Although it is preferable that the material same as the core member be used for the protection film, an ordinary adhesive made of an epoxy or the like may be used, since dielectric loss has no effect in a case different from that in the case of the core member. The order of the above-described processes from the sputtering of CrCu to completion of the patterning are not limited to the above-described order, but it is preferable that the order be changed as circumstances demand. For example, the CrCu film etc. may be formed after completion of the development and then the etching may be performed.

In the process for producing helical coil chips according to the present invention, each process such as a film formation process is performed on the whole of a surface on which coils are to be formed by a single (or one-time) film formation process. Consequently, it is possible to produce high Q helical coils even at a low cost.

According to the present invention, it is possible to form terminal electrodes on a surface on which coils are formed, so that the capacitance between electrodes can be greatly reduced. Consequently, it is possible to produce a coil chip that can maintain a high Q even at high frequencies. In addition, according to the present invention, it is possible to form terminal electrodes at the same time when the coils are formed or with a simple additional process. Therefore, the production cost of coil chips can be reduced.

According to the present invention, it is possible to form a coil on the outermost surface of a core material. Consequently, it is possible to produce a compact coil chip that has a smaller dielectric loss and a higher Q value as compared to other coil chips of the same size.

According to the present invention, when the wires firstly formed on the upper and lower surfaces of a substrate are to be connected after cutting of the substrate, a collective substrate to be used in a process of forming connecting wires is prepared by combining the cut substrates. With the use of the collective substrate, it is possible to form a film on whole of the surface on which coils are to be formed by a single film formation process upon forming these connecting wires too. Therefore, the cost of producing coil chips can be reduced further.

According to the present invention, supplemental members are used in making the collective substrate so that substrates that have been cut to have a predetermined width corresponding to the coil width can be arranged at regular intervals. With the use of the supplemental members, the collective substrate can be produced easily.

According to the present invention, in making the collective substrate, the upper and the lower surfaces are ground after the cut substrates are combined into one substrate. Therefore, it is possible to apply a single (i.e. one-time) thin film formation process, and the film formation can be performed efficiently.

What is claimed is:

1. A method of producing a helical coil chip comprising the steps of:

forming a plurality of wires extending parallel to each other with predetermined intervals on an upper surface and a lower surface of a substrate, wherein said plurality of wires on the upper and lower surfaces of said substrate are arranged to extend in the same direction;

cutting said substrate in a direction different from the direction in which said plurality of wires extend in such a way that said plurality of wires are cut to a predetermined length, into a plurality of cut substrates;

reconstructing said cut substrates as a collective substrate by means of an adhesive and a plurality of supplemental members, wherein the opposed cut surfaces of said cut substrates are arranged to face upward and downward in said collective substrate; and forming a plurality of additional wires by forming a metal film and processing thus formed metal film by thin film processing means, which have a length equal to the thickness of said substrate plus the thickness of each of said plurality of wires formed on the upper and lower surfaces of said substrate and extend parallel to each other with said predetermined intervals, on the upper and lower surfaces of said collective substrate, wherein each of said plurality of additional wires connects end portions of each of said plurality of wires formed on the upper and lower surfaces of said substrate that pass through the thickness of said collective substrate.

2. A method of producing a helical coil chip according to claim 1, wherein each of said step of forming said plurality of wires on the upper and lower surfaces of said substrate and said step of forming said plurality of additional wires on the upper and lower surfaces of said collective substrate includes a step of forming a protective film on said wires.

3. A method of producing a helical coil chip according to claim 1, wherein said step of forming a plurality of wires on the upper and lower surfaces of said collective substrate includes a step of forming a terminal electrode of said helical coil chip on either one of the upper and lower surfaces of said collective substrate.

4. A method of producing a helical coil chip according to claim 1, wherein said step of reconstructing the cut substrates as a collective substrate by means of an adhesive and a plurality of supplemental members comprises the steps of:

juxtaposing said plurality of supplemental members with regular intervals therebetween, each of said intervals being larger than the thickness of said substrate plus the thickness of said wires formed on the upper and lower surfaces of said substrate by a predetermined amount;

fitting each of said cut substrates to each of the interval spaces in such a way that the cut surfaces of the cut substrates are oriented in a direction perpendicular to the direction in which said supplemental members are juxtaposed;

combining said cut substrates and said plurality of supplemental members by means of said adhesive to form an integral element; and grinding upper and lower surfaces of said integral element, that are perpendicular to the direction in which said supplemental members are juxtaposed.

5. A method of producing a helical coil chip according to claim 1, wherein said step of reconstructing the cut substrates as the collective substrate by means of an adhesive and a plurality of supplemental members comprises the steps of:

orienting the cut surfaces of said cut substrates in a predetermined direction and arranging said cut substrates and said plurality of supplemental members alternately in a direction perpendicular to said predetermined direction;

combining said cut substrates and said plurality of supplemental members by means of said adhesive to form an integral element; and grinding upper and lower surfaces of said integral element, that are oriented in said predetermined direction so that end portions of said wires formed on the upper and lower surfaces of said substrate are exposed.

* * * * *